US008804895B2

(12) United States Patent
Bersegol et al.

(10) Patent No.: US 8,804,895 B2
(45) Date of Patent: Aug. 12, 2014

(54) CASK INTENDED TO RECEIVE A CANISTER CONTAINING RADIOACTIVE MATERIAL, AND TRANSFER METHOD FOR SAID CANISTER

(75) Inventors: Jean-Pierre Bersegol, Luzarches (FR); Justo Garcia, Courbeboie (FR)

(73) Assignee: TN International, Montigny le Bretonneux (FR)

( * ) Notice: Subject to any disclaimer, the term of this patent is extended or adjusted under 35 U.S.C. 154(b) by 1578 days.

(21) Appl. No.: 11/990,102

(22) PCT Filed: Aug. 9, 2006

(86) PCT No.: PCT/EP2006/065186

§ 371 (c)(1), (2), (4) Date: Aug. 10, 2009

(87) PCT Pub. No.: WO2007/017519

PCT Pub. Date: Feb. 15, 2007

(65) Prior Publication Data

US 2009/0304137 A1 Dec. 10, 2009

(30) Foreign Application Priority Data

Aug. 11, 2005 (FR) ..... 05 52499

(51) Int. Cl.

| | |
|---|---|
| ***G21F 5/005*** | (2006.01) |
| ***G21C 19/02*** | (2006.01) |
| ***G21F 5/14*** | (2006.01) |
| *G21F 5/00* | (2006.01) |
| *G21C 19/00* | (2006.01) |

(52) U.S. Cl.

USPC ..... 376/272; 376/260; 376/261; 376/268; 250/505.1; 250/506.1; 250/507.1; 220/500; 220/507

(58) Field of Classification Search

USPC ..... 376/260, 261, 268, 272; 976/DIG. 276, 976/DIG. 248, DIG. 343; 250/506.1, 507.1, 250/505.1; 220/248, 507, 581, 200, 243, 220/500

See application file for complete search history.

(56) References Cited

U.S. PATENT DOCUMENTS

| | | | |
|---|---|---|---|
| 3,958,701 | A | 5/1976 | Yatagai et al. |
| 4,390,040 | A | 6/1983 | Beyen |

(Continued)

FOREIGN PATENT DOCUMENTS

| | | |
|---|---|---|
| FR | 2773415 A1 | 7/1999 |
| FR | 2412145 | 7/2003 |

(Continued)

OTHER PUBLICATIONS

French International Search Report, PCT/EP2006/065186 (Sep. 10, 2006) pp. 14.

*Primary Examiner* — Bernarr Gregory
(74) *Attorney, Agent, or Firm* — Nixon Peabody LLP

(57) ABSTRACT

The invention concerns a cask for a canister containing radioactive material, comprising a canister extraction assembly and designed so that it can bring the canister to an extraction position inside the cask housing in which this canister is free of any contact with the inner surface. Also, one of two elements from among a carriage and a support structure of the assembly is provided with a guide ramp cooperating with a ramp follower provided on the other of the two elements, the ramp being designed so that a relative translational movement between the carriage and the structure, in the longitudinal direction of the cask, causes the changeover of the two elements from a drawn-together position to a drawn-apart position, or conversely.

14 Claims, 7 Drawing Sheets

(56) References Cited

U.S. PATENT DOCUMENTS

| | | | | | |
|---|---|---|---|---|---|
| 4,535,250 | A | * | 8/1985 | Fields | 250/507.1 |
| 4,711,758 | A | * | 12/1987 | Machado et al. | 376/272 |
| 4,770,844 | A | * | 9/1988 | Davis, Jr. | 376/272 |
| 4,780,269 | A | * | 10/1988 | Fischer et al. | 376/272 |
| 4,781,883 | A | * | 11/1988 | Daugherty et al. | 376/272 |
| 4,800,062 | A | * | 1/1989 | Craig et al. | 376/272 |
| 4,908,515 | A | * | 3/1990 | McLeod | 250/507.1 |
| 4,952,072 | A | * | 8/1990 | Ellingson et al. | 376/261 |
| 4,997,618 | A | * | 3/1991 | Efferding | 376/272 |
| 5,152,958 | A | * | 10/1992 | Ellingson et al. | 376/272 |
| 5,274,682 | A | * | 12/1993 | McDaniels, Jr. | 376/261 |
| 5,391,887 | A | * | 2/1995 | Murray, Jr. | 250/506.1 |
| 5,394,449 | A | * | 2/1995 | Johnson et al. | 376/272 |
| 5,406,600 | A | * | 4/1995 | Jones et al. | 376/272 |
| 5,406,601 | A | * | 4/1995 | Hinderer et al. | 376/272 |
| 5,438,597 | A | * | 8/1995 | Lehnert et al. | 376/272 |
| 5,513,232 | A | * | 4/1996 | Jones et al. | 376/272 |
| 5,546,436 | A | * | 8/1996 | Jones et al. | 376/272 |
| 5,550,882 | A | * | 8/1996 | Lehnert et al. | 376/272 |
| 5,615,240 | A | * | 3/1997 | Wolters et al. | 376/272 |
| 5,646,971 | A | * | 7/1997 | Howe | 376/272 |
| 5,748,692 | A | * | 5/1998 | Burton | 376/272 |
| 5,862,195 | A | * | 1/1999 | Peterson, II | 376/272 |
| 5,898,747 | A | * | 4/1999 | Singh | 376/272 |
| 6,064,710 | A | * | 5/2000 | Singh | 376/272 |
| 6,452,994 | B2 | * | 9/2002 | Pennington | 376/272 |
| 6,538,259 | B2 | * | 3/2003 | Matsunaga et al. | 250/506.1 |
| 6,587,536 | B1 | * | 7/2003 | Singh et al. | 376/261 |
| 6,625,246 | B1 | * | 9/2003 | Singh et al. | 376/261 |
| 6,727,510 | B2 | * | 4/2004 | Matsunaga et al. | 376/272 |
| 6,839,395 | B2 | * | 1/2005 | Ohsono et al. | 376/272 |
| 6,878,952 | B1 | * | 4/2005 | Ohsono et al. | 250/506.1 |
| 6,898,258 | B2 | * | 5/2005 | Ohsono et al. | 376/272 |
| 7,139,358 | B2 | * | 11/2006 | Singh et al. | 376/272 |
| 7,194,060 | B2 | * | 3/2007 | Ohsono et al. | 376/272 |
| 7,351,989 | B2 | * | 4/2008 | Morishige | 250/506.1 |
| 2002/0118786 | A1 | * | 8/2002 | Ohsono et al. | 376/272 |
| 2004/0062338 | A1 | * | 4/2004 | Ohsono et al. | 376/272 |
| 2005/0117688 | A1 | * | 6/2005 | Ohsono et al. | 376/272 |
| 2005/0224729 | A1 | * | 10/2005 | Tamaki | 250/507.1 |

FOREIGN PATENT DOCUMENTS

| | | | |
|---|---|---|---|
| GB | 2238298 | A | 5/1991 |
| WO | WO 03/054889 | A1 | 7/2003 |

* cited by examiner

CASK INTENDED TO RECEIVE A CANISTER CONTAINING RADIOACTIVE MATERIAL, AND TRANSFER METHOD FOR SAID CANISTER

CROSS REFERENCE TO RELATED APPLICATIONS OR PRIORITY CLAIM

This application is a national phase of International Application No. PCT/EP2006/065186 entitled "Package Serving To Accommodate A Case Containing Radioactive", which was filed on Aug. 9, 2006, which was not published in English, and which claims priority of the French Patent Application No. 05 52499 filed Aug. 11, 2005.

TECHNICAL FIELD

The present invention generally pertains to a cask intended to receive a canister containing radioactive material such as irradiated nuclear fuel assemblies, nuclear waste, etc.

It also relates to a method to transfer said canister containing radioactive material, from a cask to a receiver housing, or conversely. By way of indication, if transfer is made from the cask to the receiver housing, the housing may for example be provided at a burial site ensuring the long-term storage of this type of canister.

Finally, the invention also concerns an extraction/insertion system for said canister, whose function is to remove said canister from its associated cask and/or to insert the canister in this same cask.

STATE OF PRIOR ART

When a nuclear fuel assembly has been irradiated subsequent to its use in a nuclear plant, it may be placed in a sealed container called a canister before being placed in long-term storage, e.g. at a deep burial site.

To ensure the transport of the canister towards the long-term storage site, the canister is first placed in a cask called a transfer cask to form an assembly called a waste package.

It is then the entirety of the package which is transported to the burial site at which a transfer method is used to transfer this canister from the transfer cask to a receiver housing on the site.

For this purpose, provision is generally made to align the cask holding the canister with the receiver housing, preferably horizontally, then to pull or push this canister in order to transfer it from its transfer cask to its associated receiver housing. This technique is particularly described in document U.S. Pat. No. 4,780,269, relating to a surface storage installation.

The major drawback with said embodiment lies in the fact that when the canister is extracted from its cask, the outer side surface of this canister undergoes major friction against the inner surface of the cask delimiting the cask housing.

This friction may lead to the tearing of particles from the outer side surface of the canister, exposing the canister to risks of corrosion which may be detrimental to the integrity of this canister during its long-term storage at the disposal site.

Finally, it is to be noted that the phenomenon of particle stripping described above may also be observed at the time the canister is placed in its cask, when it is arranged horizontally, owing to similar friction which may occur against the inner surface of the cask housing.

OBJECT OF THE INVENTION

The purpose of the invention is therefore to propose a cask whose design can at least partly remedy the above-mentioned drawbacks of prior art embodiments.

The purpose of the invention is also to present a package comprising said cask, and to propose a system to extract a cask containing radioactive material.

Another purpose of the present invention is to propose an extraction/insertion system for said canister, whose function is to remove this canister from its associated cask and/or to insert the canister in this same cask.

Finally, a further purpose of the present invention is to propose a transfer method for a canister containing radioactive material, from a cask to a receiver housing or conversely.

To do so, the object of the invention is firstly a cask intended to receive a canister containing radioactive material, this cask having a inner surface delimiting a cask housing for this canister. According to the invention, it also comprises an extraction/insertion assembly for the canister bearing on the inner surface, this extraction/insertion assembly being designed so that the canister can be moved inside the cask housing along a longitudinal direction of the cask, in a carried position in which this canister is free of any contact with the inner surface. In addition, the canister extraction assembly is provided with a carriage, bearing against the inner surface, and with a canister support structure carried by the carriage, the carriage and support structure being designed so that they are able to assume a position in which they are drawn together in a radial direction of the cask, allowing contact between the canister and the inner surface, and a position in which they are drawn apart from each other in the radial direction of the cask, in which the canister borne by the support structure takes up its carried position. Finally, according to the invention, one of the two elements from among the carriage and support structure is provided with at least one guide ramp cooperating with a ramp follower provided on the other of the two elements, the ramp being made so that application of a relative translational movement between the carriage and the canister support structure in a longitudinal direction of the cask, causes the two elements to change over from the drawn-together position to the drawn-apart position, or conversely.

One of the specificities of this cask, compared with those found in the prior art, therefore lies in the fact that it integrates a canister extraction/insertion assembly whose design allows this canister to be spaced away from the inner surface delimiting the cask housing, before starting to extract this canister. Therefore, during such extraction when the canister in contact with the assembly takes up its carried position, the lack of any contact and friction between this canister and the inner surface avoids the tearing away of particles on the outer side surface of the canister, and eliminates associated risks of corrosion. Similarly, the carried position can also be taken up by the canister in contact with the extraction/insertion assembly before it is inserted into the cask. This specificity allows the canister, when it is being inserted inside the cask, not to be in contact either with the inner surface of the cask before it has been fully inserted inside its cask housing.

As arises from the foregoing, it is to be understood that the extraction/insertion assembly can be used either to ensure removal of the canister from the cask housing, or to ensure insertion of this canister inside this same cask, or to ensure both above-cited application. In each of these two procedures, when the canister lies fully outside its cask housing, the assembly carrying the cask may also take up an outside position in which it is fully extracted from a cask body defining the inner surface. On the other hand, when the canister lies fully inside the cask housing, as is the case in particular during its transport, the assembly is in a retracted position in which it lies fully within the cask body.

Additionally, as indicated above, the canister extraction assembly is provided with a carriage bearing against the inner surface and with a canister support structure carried by the carriage, the carriage and support structure being designed so that they can assume a position in which they are drawn close to each other in a radial direction of the cask, allowing contact between the canister and the inner surface, and a position in which they are drawn apart in the radial direction of the cask in which the canister carried by the support structure takes up its carried position. Therefore, it will be understood that design of the assembly allows it to be positioned at any point around the inner surface and against it, even if a preferred position consists of making provision for it to rest on a lower end portion of this inner surface, when the cask is arranged horizontally or slightly at an angle to the horizontal, as is usually the case for the transfer of the canister to a receiver housing. This preferred positioning allows the canister to rest simply under gravity on the support structure, when the extraction assembly lies in its drawn-apart radial position bringing this canister to its carried position. Evidently, other positions of the extraction assembly within the cask, requiring the provision of securing means to secure the canister to the structure support so that this canister is maintained in its carried position, can be envisaged without departing from the scope of the invention.

Also, as specified above, one of the two elements from among the carriage and support structure is provided with at least one guide ramp cooperating with a ramp follower provided on the other of the two elements, the ramp being designed so that application of a relative translational movement between the carriage and the canister support structure, in a longitudinal direction of the cask, causes the changing of the two elements from the drawn-together position to the drawn-apart position, or conversely. Therefore, one advantage provided by said configuration is that the relative movement required to obtain the changeover from one position to another must be made in a direction that is identical to the direction of extraction of the canister from its cask. Therefore, it then advantageously becomes possible to use the same mobilizing means to ensure insertion of the canister in its cask, the extraction of the canister out of its cask e.g. to implement a transfer method towards a deep burial site, and also to ensure the changeover from the drawn-together position to the drawn-apart position, and conversely.

Preferably the carriage used is a travelling carriage rolling on the inner surface of the cask. However, it could evidently be a rail-mounted or slipper pad carriage without departing from the scope of the invention. In parallel, it is preferably provided that the above-mentioned ramp follower is a roller.

Again preferably, the canister extraction assembly is arranged in a cavity opened towards the cask housing, and defined by the inner surface of the cask. Here again, it could alternatively be provided that the open cavity is made on the outer side surface of the canister and not on the inner surface of the cask, or this cavity could be defined jointly by the inner surface of the cask and by the outer side surface of the canister.

Finally, if the cavity is defined by the inner surface, provision is preferably made for the cask to have two canister supports partly defining the inner surface and being spaced at an angle around a longitudinal axis of the cask, so as partly to delimit this open cavity between them. Naturally other configurations may be envisaged, such as one in which the entirety of the inner surface is provided on a single-piece body.

Another object of the present invention concerns a package of radioactive material, comprising a cask such as described above and a canister containing the radioactive material and arranged inside the cask housing.

A further object of the invention relates to an extraction/insertion system for a canister containing radioactive material, this canister being intended to be extracted/inserted in a cask housing delimited by an inner surface of a cask. According to the invention, the system comprises a canister extraction/insertion assembly such as described above and whose design is such that the application of a relative translational movement between the carriage and the canister support structure in the longitudinal direction of the cask, causes a changeover of the two elements from the drawn-together position to the drawn-apart position, or conversely, this extraction system also comprising mobilizing means in a longitudinal direction of the cask connected to one of the two elements, and retractable abutment means cooperating with the other of the two elements. Evidently, in this system in which the mobilizing means are preferably connected to the carriage of the assembly, the retractable abutment means are piloted so that the utilisation of these mobilizing means alternately cause displacement of the entirety of the assembly in a longitudinal direction of the cask, and a relative movement between the two elements so that they over from the drawn-together position to the drawn-apart position, or conversely.

By connecting the mobilizing means to the carriage and by causing the retractable abutment means to cooperate with the support structure, it is advantageously observed that during simultaneous locking of this structure and longitudinal movement of the carriage, the canister support structure is then moved solely in radial direction, which does not induce any relative movement between the canister and this support structure. Any friction between these two, elements is therefore advantageously prevented.

It is noted that this system is preferably intended to be used for implementation of a method to transfer a canister containing radioactive material from a cask towards a receiver housing, such as the method which is described below and which is also a subject of the invention. Nonetheless, it may also be intended for implementation of a canister transfer method in which this canister is to be extracted from a receiver housing for insertion inside a cask, without departing from the scope of the invention.

Also, it is noted that the system may be such that its canister extraction/insertion assembly forms an integral part of the cask, as is the case for the cask subject of the invention. However, alternatively, this assembly could be an integral part of the means defining the receiver housing, or of any other means such as a motorized vehicle.

The method of the invention therefore relates to a transfer method for a canister containing radioactive material, from a first to a second entity from among the group consisting of a cask such as described above and a receiver housing delimited by an inner surface. It comprises the following successive steps consisting of:

- bringing the canister located inside the first entity to a carried position in which this canister is devoid of any contact with the inner surface associated with this first entity;
- setting in movement the extraction/insertion assembly carrying the canister so as to cause this extraction assembly and the canister to enter inside the second entity.

Therefore, in the preferred case in which the first entity is a cask, the second stated step then consists of mobilizing the extraction/insertion assembly carrying the canister, in a direction of extraction of lying in the longitudinal direction of the cask, so as to cause the extraction assembly and the canister to enter inside the receiver housing.

Preferably, if the method is intended to ensure transfer from the cask housing to a receiver housing, it also comprises the following successive steps consisting of:

- bringing the canister to a position in which it is deposited inside the receiver housing wherein this canister is devoid of any contact with the extraction assembly;
- setting in movement the extraction assembly in a direction opposite to the extraction direction, so as to re-insert this extraction assembly inside the cask.

Preferably, the canister extraction assembly used belongs to the extraction system presented above, which is used to implement this transfer method.

Therefore, provision can be made so that the step consisting of bringing the canister to its carried position inside the cask is performed by carrying out the following successive operations:

- connecting means to mobilize the extraction system to one of the two elements, either the carriage or the support structure, of the extraction assembly;
- actuating a first abutment belonging to the retractable abutment means, so as to bring this first abutment from a retracted position to an abutment position, allowing the locking in translation of the other of the two elements in the extraction direction lying in the longitudinal direction of the cask;
- actuating the mobilizing means in the direction of extraction to cause displacement of the carriage and support structure from the drawn-together position to the drawn-apart position; and
- actuating the first abutment so as to bring it from the abutment position to the retracted position.

Naturally, it would also have been possible to provide a type of guide ramp requiring actuation of the mobilizing means in the opposite direction to the extraction direction in the longitudinal direction of the cask, in order to cause changeover from the drawn-together position to the drawn-apart position, without departing from the scope of the invention.

Still preferably, the step consisting of bringing the canister to a deposited position inside the receiver housing is conducted by implementing the following successive operations:

- actuating a second abutment belonging to the retractable abutment means so as to bring this second abutment from a retracted position to an abutment position, allowing the locking in translation of the other of the two elements in the opposite direction to the extraction direction;
- actuating mobilizing means in the opposite direction in order to cause changeover of the carriage and support structure from the drawn-apart position to the drawn-together position; and
- actuating the second abutment so as to bring it from the abutment position to the retracted position.

Other advantages and characteristics of the invention will become apparent on reading the detailed, non-limiting description given below.

BRIEF DESCRIPTION OF THE DRAWINGS

This description will be made with reference to the appended drawings among which.

DETAILED DESCRIPTION OF PREFERRED EMBODIMENTS

Figure 1:
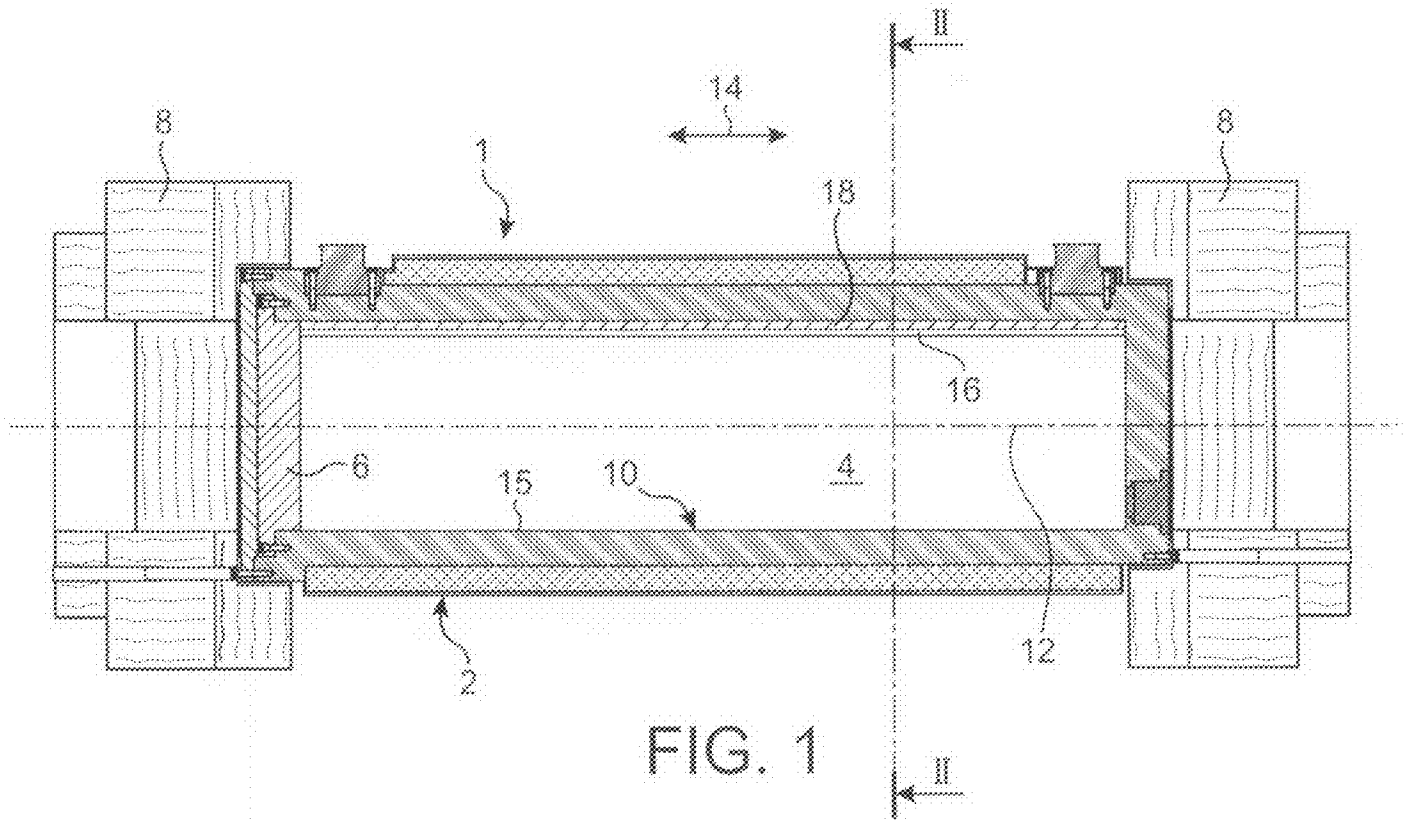
FIG. 1 is a longitudinal cross-section along I-I of FIG. 2*a*, showing a cask intended to receive a canister containing radioactive material, according to one preferred embodiment of the present invention.
Figure 2A:
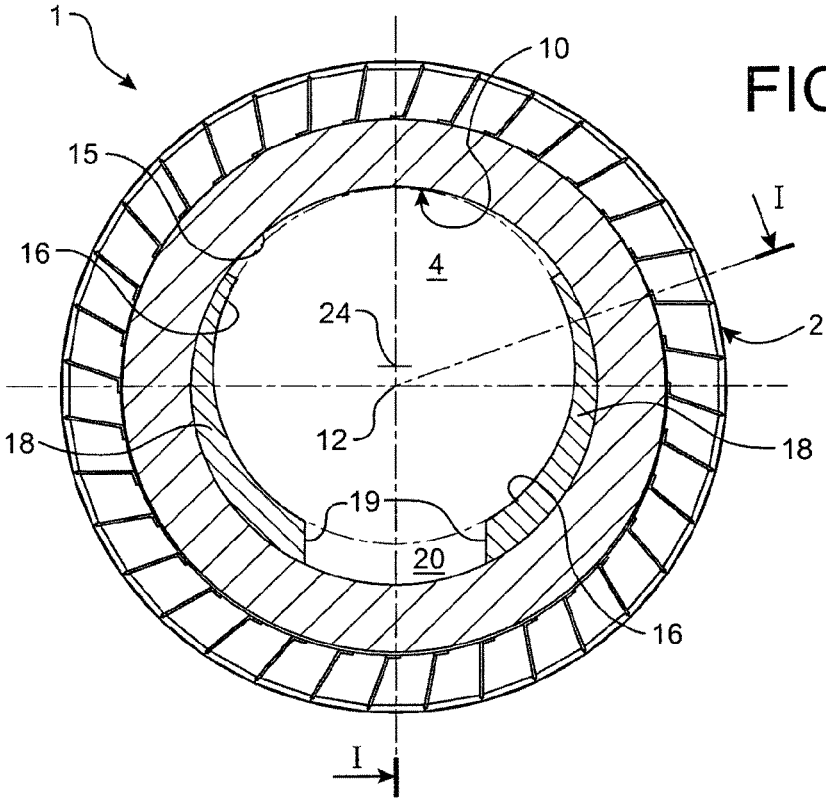
FIG. 2*a* is cross-sectional view along line II-II of FIG. 1.

With reference firstly to FIGS. 1 and 2*a*, a cask is shown intended to receive a canister (not shown) containing radioactive material, this cask being in the form of a preferred embodiment of the present invention.

The cask 1 globally comprises a hollow cask body 2 of cylindrical shape and defining a cask housing 4, a lid 6 closing the housing 4, and two covers 8 respectively arranged at the two ends of the cask body 2. The above-mentioned elements are of conventional design known to those skilled in the art, and therefore allow the housing of a canister containing irradiated nuclear fuel assemblies for example and/or nuclear waste. They therefore ensure the usual functions of neutron protection, protection against gamma radiation, and mechanical resistance.

One of the particularities of the present invention consists firstly of providing that the cask housing 4 is delimited by a cask inner surface 10 whose section is not circular, contrary to cask sections found in the prior art intended to receive cylindrical canisters of circular section.

As can be seen more clearly in FIG. 2*a*, the inner surface 10 is jointly delimited firstly by an inner cylindrical wall with circular section 15 of the body 2, arranged along a longitudinal axis 12 of the cask parallel to a longitudinal direction 14 of this same cask, and secondly by two support surfaces 16 respectively belonging to two canister supports 18 mounted fixedly on the above-mentioned inner wall 15.

The two supports 18, therefore partly defining the inner surface 10, are spaced at an angle around the longitudinal axis 12. Therefore, when the cask 1 lies in a substantially horizontal position such as shown FIG. 2*a* and corresponding to the position taken up during transfer of the canister towards a receiver housing, the two supports 18 arranged symmetrically with respect to a median vertical plane of the cask, together delimit a cavity 20 open towards the cask housing 4 and closed downwardly by a lower portion of the inner wall 15.

More precisely, it is noted that the open cavity 20 is partly delimited by the two lower sides 19 of the two canister supports 18 preferably extending substantially over the entire length of the body 2, and that the two support surfaces 16 of these canister supports 18 are cylindrical portions of circular section arranged along one same longitudinal axis 24, preferably separate from the longitudinal axis 12 of the cask 1.

Therefore, it is to be understood that the inner surface 10 is designed to delimit both the cask housing 4 and the open cavity 20 leading into it. Nevertheless, it is specified that this inner surface 10 could be obtained in another manner, other than by adding canister supports on an inner wall 15 of circular section of body 2, without departing from the scope of the invention.

The open cavity 20, which is therefore preferably located in the lower part of the body 2 when the cask is in canister transfer position, is intended to receive a canister extraction/insertion assembly 36 such as the one which will now be described with reference to FIG. 3.

In this figure, it can be seen that the canister extraction/insertion assembly 36, hereinafter called canister extraction assembly, globally consists firstly of a carriage 38 intended to bear against the inner surface 10, and more precisely against the lower portion of the inner wall 15 which delimits the open cavity 20, and secondly of a canister support structure 40 carried by this carriage 38. The structure 40 therefore has an upper part of upwardly incurved shape as is clearly visible FIG. 3, so that it is able to hold this canister when it is solely carried by this same support structure 40. The longitudinal direction 14 of the cask is shown so as to indicate the positioning of the assembly 36 inside the cask 1, this assembly 36 preferably extending substantially over the entire length of the cask body 2, in cavity 20.

Also, it can be seen that the carriage 38 is preferably a carriage able to run over the lower portion of the inner wall 15 which delimits the open cavity 20.

Figure 3:
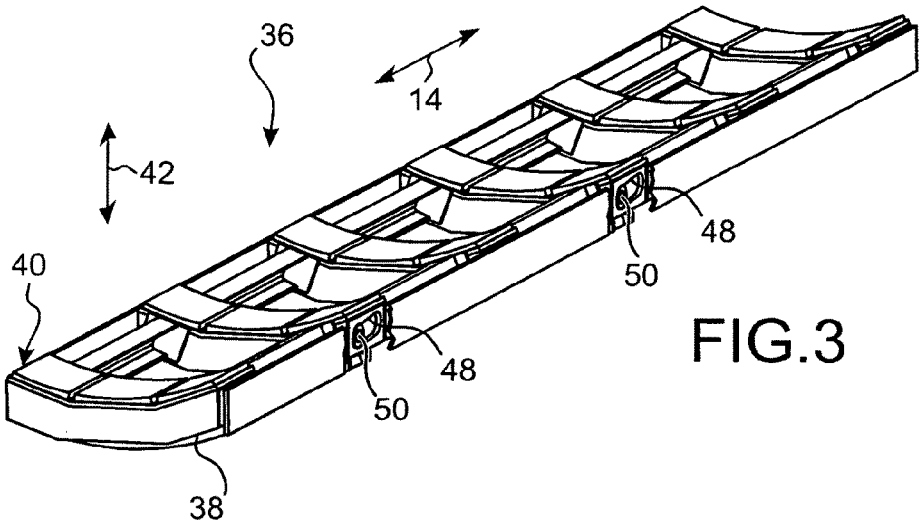
FIG. 3 is a perspective view of the extraction assembly shown FIG. 2*b;*

The above-mentioned carriage 38 and structure 40 are designed so that they can take up a drawn-together position in a radial direction of the cask 1, schematically illustrated by arrow 42 in FIG. 3, and a drawn-apart position in this same direction 42, orthogonal to direction 14.

Figure 4A:
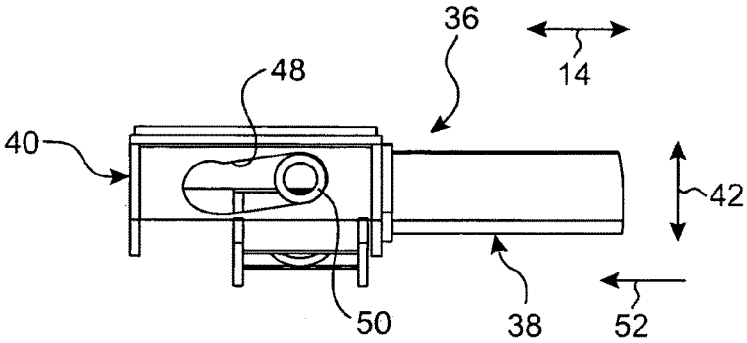
FIGS. 4*a* and 4*b* are side views of part of the extraction assembly in FIG. 3, respectively in the drawn-together position and in the drawn-apart position allowing this assembly to carry the canister so that it is no longer in contact with the inner surface of the cask housing.

In FIG. 4*a* partly showing the assembly 36 in the same configuration as in FIG. 3, i.e. when the carriage 38 and structure 40 assume their drawn-together position, it can be seen that the support structure 40 is provided with several guide ramps 48 (only one being shown in this FIG. 4*a*), whilst the carriage 38 is equipped with a ramp follower 50 associated with each of the ramps 48 and in the form of a roller. In this respect it can be seen FIG. 3 that the assembly 36 is effectively provided with several ramp/roller assemblies, preferably distributed on each side of this assembly.

In the drawn-together position, for each ramp/roller assembly, the roller 50 bears on an upper rear end of the ramp 48, whose geometric shape is such that it descends in the longitudinal direction 14, in the direction of canister extraction schematically illustrated by arrow 52. Evidently, the notion of <<descent>> is to be considered when the extraction assembly 36 rests in the open cavity 50 located in a lower part of the body 2 of cask 1 arranged horizontally, such as is shown FIG. 2*a*.

Figure 4B:
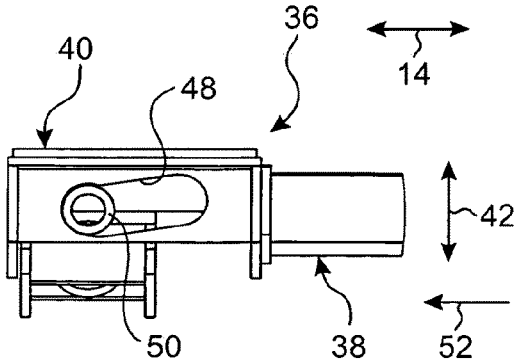

With said geometry, the ramp 48 is therefore designed so that the application of a relative translational movement between the carriage 38 and the canister support structure 40, in direction 14 of the cask, causes the changeover of these two elements 38, 40 from the drawn-together position to the drawn-apart position. As can be seen FIG. 4*b*, the application of said relative movement intended to move the carriage 38 in the direction of extraction 52 relative to the canister support structure, results in moving the roller 50 inside its associated ramp 48, until this roller 50 reaches a lower front end of this ramp 48. It is therefore the particular geometry of the ramp 48, through which the roller 50 passes, which allows the automatic causing of a relative radial movement drawing apart the two elements 38, 40, subsequent to mere application of a relative movement in the longitudinal direction 14 of the cask.

Naturally, the above-mentioned notions <<front>> and <<rear>> can be respectively likened to so-called notions of <<towards the opening>> and <<towards the bottom part>> of the cask housing 4, when the cask 1 has been positioned horizontally for extraction of the canister, a position in which direction 14 is substantially parallel to the horizontal.

Also, the application of a relative movement intended to move the carriage 38 in the direction of extraction 52 relative to the structure 40 results in moving the roller 50 inside its associated ramp 48 until the roller 50 meets up with the upper front end of this ramp 48. This then ensures changeover of the assembly 36 from the drawn-apart position to the drawn-together position. In this respect, it is specified that the upper front end and the lower rear end may each be provided with a notch into which the roller can enter 50 for the purpose of firmly maintaining the drawn-together and drawn-apart positions.

Figure 2B:
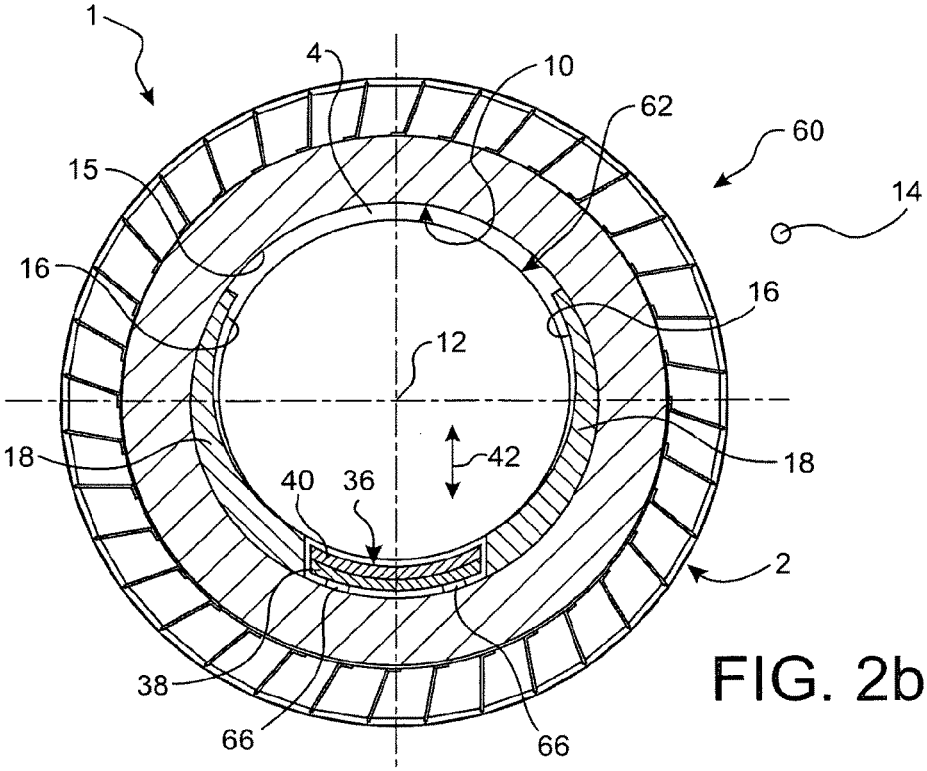
FIG. 2*b* is a similar view to that of FIG. 2*a*, in which the canister extraction assembly of the cask is shown in a drawn-together position ensuring depositing of the canister on the inner surface of the cask housing.

In FIG. 2*b*, a package 60 can be seen comprising the cask 1 provided with the canister extraction assembly 36, and a canister 62 sealingly containing radioactive material and preferably being made in copper. This canister 62 is preferably cylindrical and of circular section.

In this FIG. 2*b*, the extraction assembly 36 resting in its lower open cavity 20, is shown in the drawn-together position in which its two elements 38, 40 are sufficiently drawn close to one another in the radial direction 42 so that the canister 62 is able to rest under gravity on surfaces 16 of the two supports 18, without being in contact with the support structure 40 carried by the carriage 38 itself equipped with wheels 66 in contact with the inner wall 15 partly delimiting cavity 20. In addition, an upper part of this canister 62 is spaced away from the inner wall 15 of the body 2, and rests in a so-called deposited position in its cask housing 4, in which it is solely in contact with the lower portions of the surfaces 16.

Figure 5:
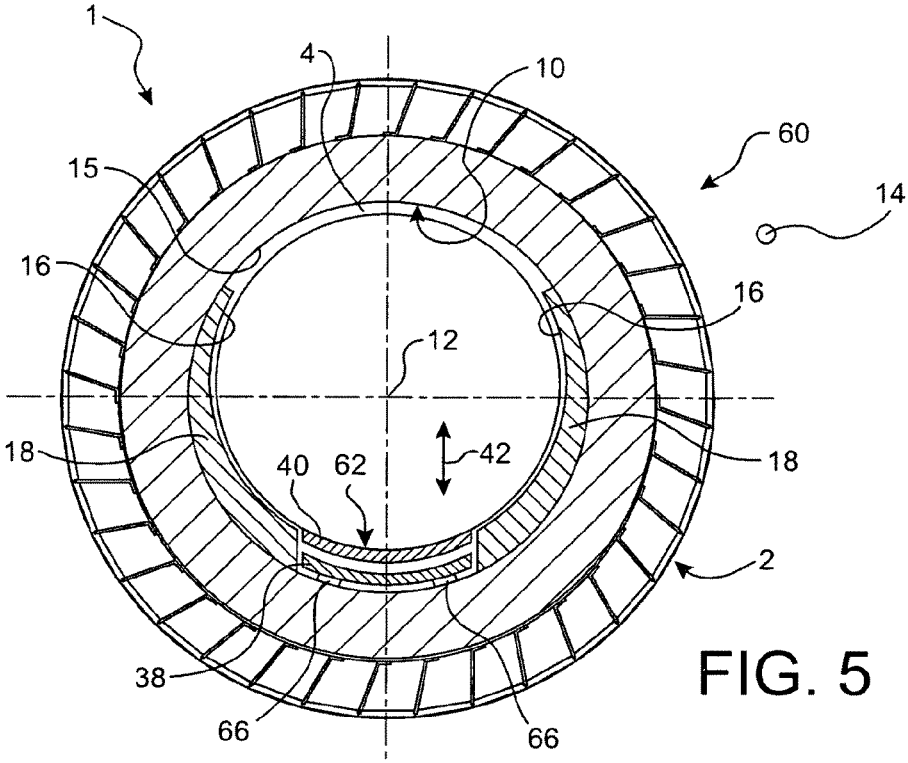
FIG. 5 is a cross-sectional view similar to the one in FIG. 2*b*, in which the canister extraction assembly is shown in said drawn-apart position.

On the other hand, as can be seen FIG. 5, when the extraction assembly 36 takes up its drawn-apart radial position, its support structure 40 lifts up the canister 62 by entering inside the housing 4, which causes this canister 62 to take up a so-called carried position in which it is no longer in contact at all with the inner surface 10, and hence no longer in contact with the supports 18 from which the canister 62 has been drawn away. The canister 62 is then solely held by the support structure 40, owing to gravity and the incurved shape of this structure preventing this canister from escaping sideways.

Consequently, to ensure extraction of the canister 62 out from the cask without damaging its outer side surface, all that is required is to set assembly 36 in movement in direction 14, and more particularly in the direction of extraction 52. Therefore the canister 62 placed in movement advantageously does not undergo any friction since it remains fixed with respect to the structure 40 which lifts it, and it is the wheels 66 of the carriage 38 which move along the inner surface 10 in the longitudinal direction 14.

In this respect, the invention also relates to a transfer method for said canister 62 containing radioactive material, from a cask 1 towards a receiver housing, or conversely, this receiver housing possibly being provided at a burial site for the long-term storage of this type of canister.

FIGS. 6*a* to 6*f* shows different successive steps of a transfer method according one preferred embodiment of the present invention, whose implementation is preferably ensured by a canister extraction/insertion system 70 also subject of the invention.

This embodiment concerns a preferred non-limiting case in which the method consists of ensuring transfer of a canister from a cask 1 to a receiver housing. For this reason, the system 70 will be called an extraction system 70 in the remainder hereof.

Figure 6A:
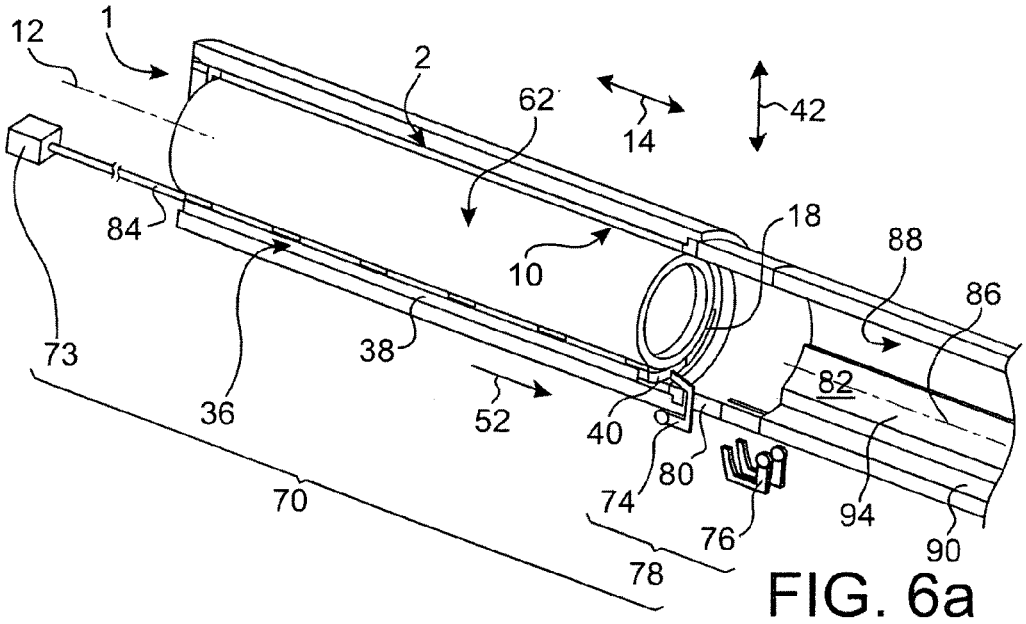
FIGS. 6*a* to 6*f* show perspective views schematising different successive steps of a method to transfer a canister containing radioactive material, according to one preferred embodiment of the present invention.

As can be seen FIG. 6*a*, this system 70 globally comprises the canister extraction assembly 36 already described and intended to equip cask 1, mobilizing means 73 in direction 14 connected to the carriage 38, and retractable abutment means 78 cooperating with the support structure 40. Globally, as will be seen below in the description of the method, it is to be understood that this system 70 is designed and piloted so that it can generate movement of the canister 62 in direction 14, and its radial displacement, intended for example to cause it to change from its deposited position inside housing 4 to its carried position.

With reference therefore to FIG. 6*a*, it can be seen that the method to transfer canister 62 consists firstly of conducting a series of preparatory operations such as opening the cask 1 by removing its upper cover 8 and lid 6, placing this cask 1 on a docking cylinder 80 positioned in the continuation of the receiver housing 82 into which the canister 62 is to be transferred, and connecting the mobilizing means 73 to the extraction assembly 36 e.g. by passing a telescopic arm 84, oriented in direction 14 and forming an integral part of means 73, through the bottom part of the cask body 2.

Before starting the transfer operations, it is therefore ensured that the longitudinal axis of the cask merges with a longitudinal axis 86 of the receiver housing 82, which is delimited by inner surface 88 whose shape is preferably identical to the shape of the inner surface 10 of the cask 1, and which therefore also delimits a lower cavity 90 opened towards the receiver housing 82.

As already mentioned above, it is also ensured that the open cavity 20 is located at a lower part of the cask 1 positioned horizontally or slightly at an angle with respect to the horizontal.

When the cask 1 is correctly positioned relative to the receiver housing 82, a first step consists of bringing the canister 62 to its carried position inside the cask housing 4, i.e. to cause the extraction assembly 36 to change over from the drawn-together radial position to the drawn-apart radial position.

For this purpose, once the mobilizing means 73 are mechanically joined to the carriage 36, a first abutment 74 is actuated belonging to the retractable abutment means 78, so as to bring this first abutment 74 from a retracted position to an abutting position such as shown FIG. 6*a*. In this abutting position the first abutment 74 crossing cask 1 or the docking cylinder 80 comes to abut a front end of the support structure 40, thereby allowing the latter to be locked in translation in the direction of extraction 52.

Figure 6B:
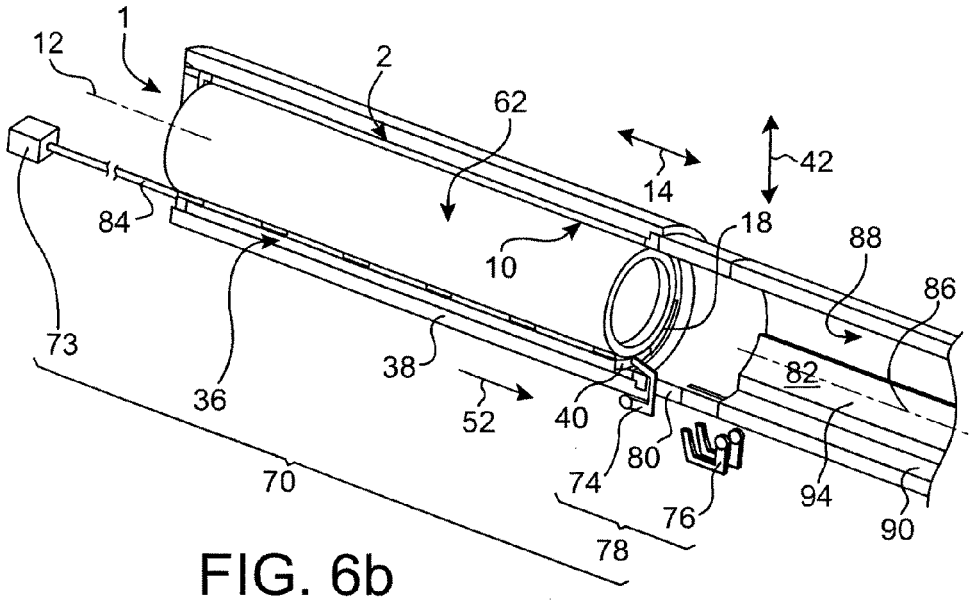

The mobilizing means 73 can then be actuated in the direction of extraction 52 in order to cause relative movement between the support structure 40 locked longitudinally in translation and the carriage 38 directly driven by these means 73, for the purpose already described of causing these elements 38, 40 to change over from the drawn-together position to the drawn-apart position shown FIG. 6*b*. During this operation, it is noted that the support structure 40 advantageously only undergoes a radial translational movement, which prevents friction against the outer side surface of the canister.

Then, once contact has been released between the canister 62 and the inner surface 10, the first abutment 74 is actuated so as to return it to its retracted position in which it releases the structure 40 which is then no longer locked in translation in the direction of extraction 52. By way of indication, it is noted that this abutment 74 can for example be pivot-mounted on the cask body 2, and be piloted manually or automated fashion.

Figure 6C:
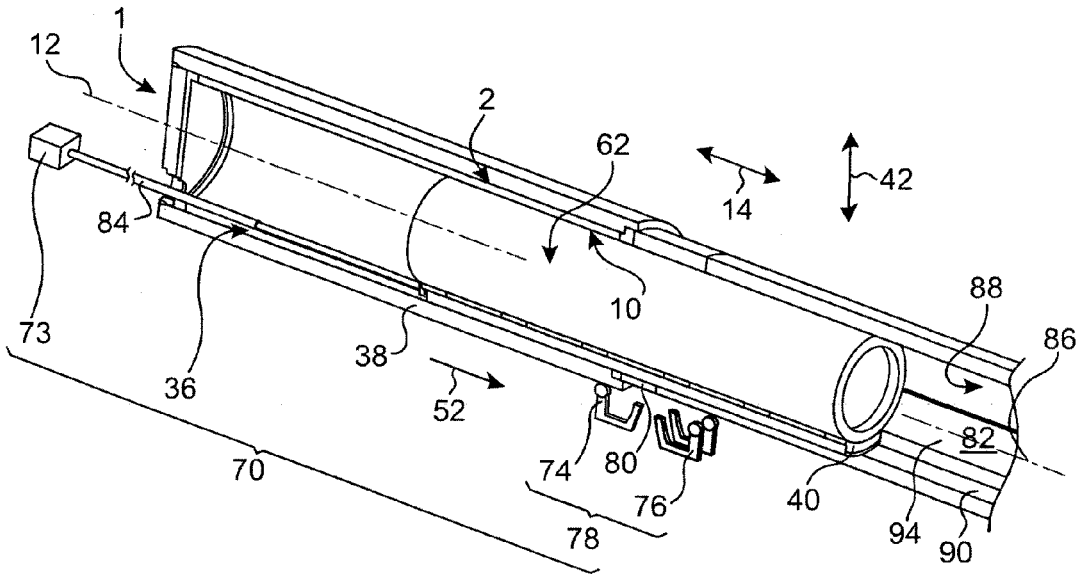

The following step consists of setting in movement the extraction assembly 36, lifting the canister 62, in the direction of extraction 52 and using mobilizing means 73, so as to cause this assembly 36 and the canister 62 to enter inside the receiver housing 82, as shown FIG. 6*c*. At the time of entering, it is observed that the assembly 36 comes to insert itself in the lower open cavity 90 delimited by inner surface 88 and located in the continuation of lower open cavity 20 of the cask.

Once the canister 62 has been inserted to a sufficient depth inside housing 82, the step is conducted of bringing this canister to its deposited position inside the receiver housing 82, in which this canister is free of any contact with the extraction assembly 36 but in which it rests on the inner surface 88, preferably on two canister supports 94 (only one being illustrated), identical to supports 18 and located in the continuation thereof.

Figure 6D:
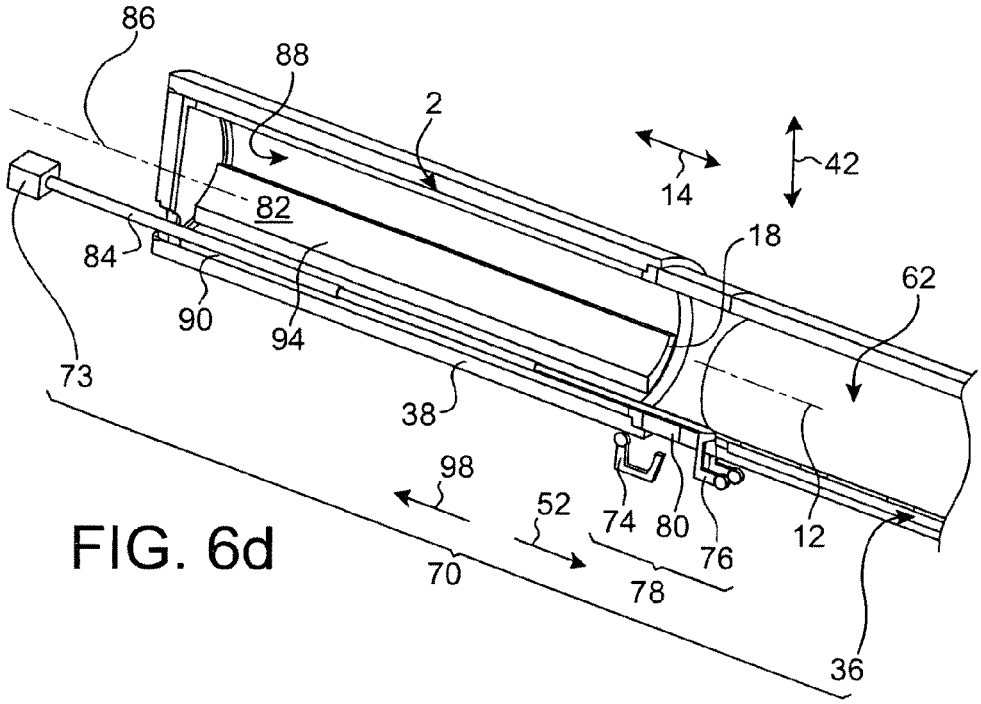

To do so, a second abutment 76 is actuated belonging to the retractable abutment means 78, so as to bring this second abutment 76 from a retracted position to an abutment position such as shown FIG. 6*d*. In this abutment position, the second abutment 76 crossing the docking cylinder 80 comes to abut a rear end of the support structure 40, therefore ensuring the locking in translation of this structure in an opposite direction 98 to the direction of extraction 52.

Figure 6E:
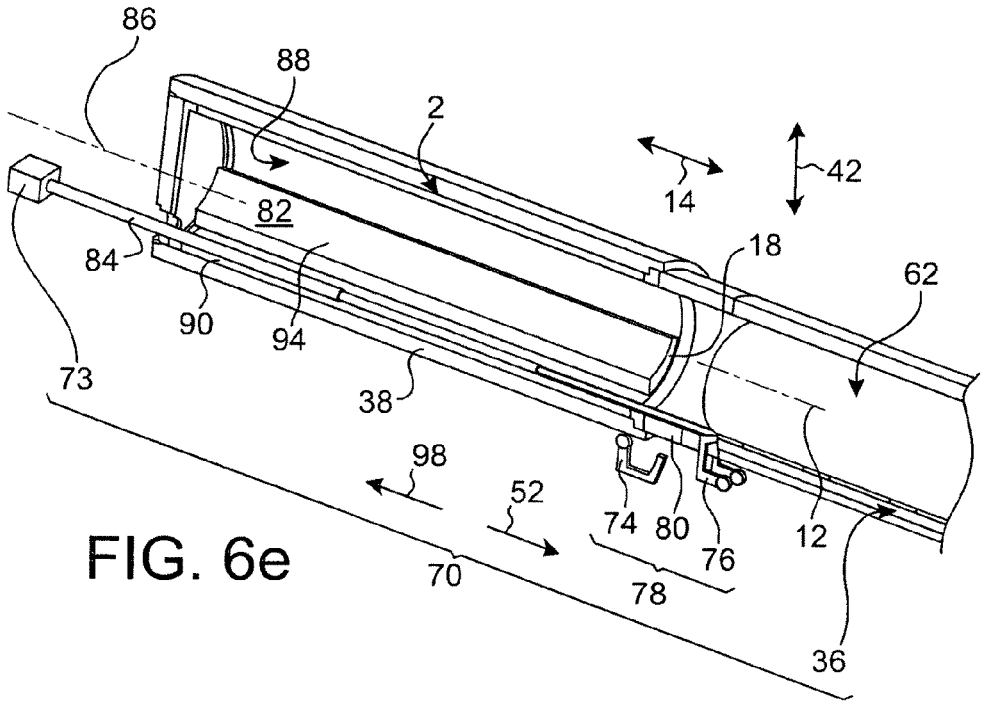

The mobilizing means 73 can then be actuated in the opposite direction 98 to cause relative movement between the structure 40 locked in translation and the carriage 38 directly driven by these means 73, for the purpose of causing these elements 38, 40 to change over from the drawn-apart position to the drawn-together position shown FIG. 6*e*.

Next, once contact has been released between the canister 62 and the support structure 40, the second abutment 76 is actuated to return it to its retracted position in which it releases the structure 40 which is then no longer locked in translation in the opposite direction 98. By way of indication, it is noted that this abutment 76 may for example be pivot-mounted on the docking cylinder 80 or on the body delimiting the receiver housing 82, and can be automatically or manually piloted.

Figure 6F:
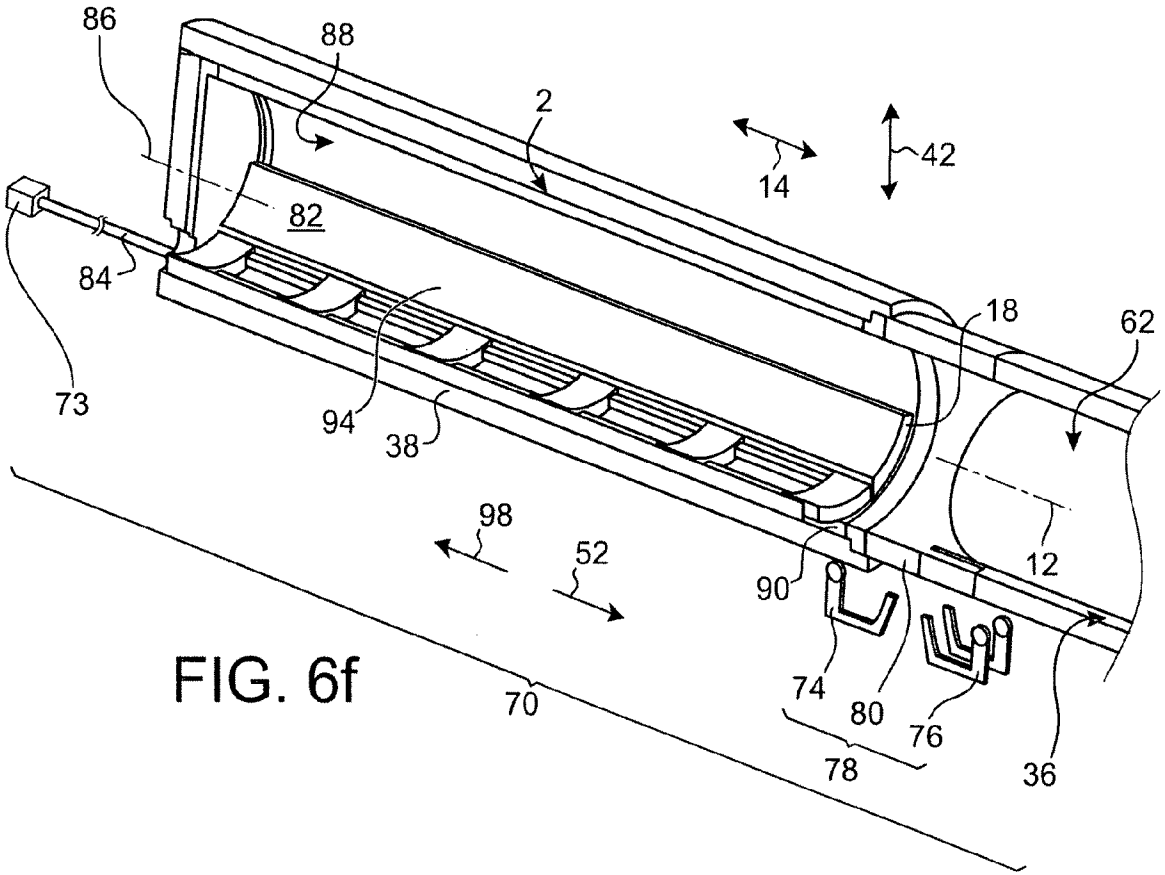

Finally, to complete this transfer method, the extraction assembly 36 is again set in movement in the opposite direction 98 so that it can be re-inserted inside the cask 1, without the canister 62, in its associated open cavity as can be clearly seen FIG. 6*f*. Thereafter the mobilizing means 73 can be uncoupled from the carriage 38 and the cask separated from the docking cylinder 80, so that this cylinder can again be used for another canister-transfer.

Naturally, it is to be understood that if the method of the invention is intended to ensure the transfer of a canister from a receiver housing towards a cask 1, the steps to be conducted are implemented in reverse order to the order just described.

Evidently, various modification may be made by persons skilled in the art to cask 1, package 60, extraction system 70 and the transfer method which have just been described solely as non-limiting examples.

The invention claimed is:

1. A cask configured to receive a canister containing radioactive material, said cask having an inner surface delimiting a cask housing to receive the canister, said cask also comprising a canister extraction/insertion assembly bearing against said inner surface, the canister extraction/insertion assembly configured to move the canister inside the cask housing in a longitudinal direction of the cask, in a carried position in which this canister is free of any contact with said inner surface, characterized in that said canister extraction/insertion assembly is provided with a carriage bearing against said inner surface and with a canister support structure carried by said carriage, said carriage and support structure configured to take up a drawn-together position in a radial direction of the cask allowing contact between the canister and said inner surface, and a drawn-apart position in the radial direction of the cask in which the canister carried by the support structure takes up its carried position, and in that one of the two elements from among said carriage and said support structure is provided with at least one guide ramp cooperating with a ramp follower provided on the other of said two elements, said ramp configured so that-application of a relative translational movement between the carriage and canister support structure, in the longitudinal direction of the cask, causes a changeover of said two elements from said drawn-together position to said drawn-apart position, or conversely.

2. A cask according to claim 1, characterized in that said carriage is a travelling carriage, and in that said ramp follower is a roller.

3. A cask according to claim 1, characterized in that said canister extraction/insertion assembly is arranged in a cavity opened towards the cask housing, and defined by said inner surface of the cask.

4. A cask according to claim 3, characterized in that it comprises two canister supports partly defining said inner surface and being spaced at an angle around a longitudinal axis of the cask, so as to partly delimit said open cavity between them.

5. A package of radioactive material, characterized in that it comprises:

a cask configured to receive a canister containing radioactive material, said cask having an inner surface delimiting a cask housing to receive the canister, said cask also comprising a canister extraction/insertion assembly bearing against said inner surface, the canister extraction/insertion assembly configured to move the canister inside the cask housing in a longitudinal direction of the cask, in a carried position in which this canister is free of any contact with said inner surface, said canister extraction/insertion assembly is provided with a carriage bearing against said inner surface and with the canister support structure carried by said carriage, said carriage and support structure configured to take up a drawn-together position in a radial direction of the cask allowing contact between the canister and said inner surface, and a drawn-apart position in the radial direction of the cask in which the canister carried by the support structure takes up its carried position, and in that one of the two elements from among said carriage and said support structure is provided with at least one guide ramp cooperating with a ramp follower provided on the other of said two elements, said ramp configured so that-application of a relative translational movement between the carriage and canister support structure, in the longitudinal direction of the cask, causes a changeover of said two elements from said drawn-together position to said drawn-apart position, or conversely, and the canister containing said radioactive material and arranged inside said cask housing.

6. A package of radioactive material according to claim 5, characterized in that the canister is of cylindrical shape and has a circular section, and contains at least one of irradiated nuclear fuel assemblies and nuclear waste.

7. An extraction/insertion system for a canister containing radioactive material, the canister configured to be extracted from and inserted in a cask housing delimited by an inner surface of a cask, characterized in that said system comprises a canister extraction/insertion assembly configured to bear against said inner surface of the cask and being provided with a carriage and canister support structure carried by said carriage, said carriage and support structure configured to take up a drawn-together position in a radial direction of the cask allowing contact between the canister and said inner surface, and a drawn-apart position in the radial direction of the cask in which the canister carried by the support structure takes up a carried position in which this canister is free of any contact with said inner surface, one of the two elements from among said carriage and said support structure being provided with at least one guide ramp cooperating with a ramp follower provided on the other of said two elements, said ramp configured so that the application of a relative translational movement between the carriage and canister support structure, in a longitudinal direction of the cask, causes a changeover of said two elements from said drawn-together position to said drawn-apart position, or conversely, said extraction system also comprising mobilizing means in the longitudinal direction of the cask connected to one of said two elements, and retractable abutment means cooperating with the other of said two elements.

8. An extraction/insertion system according to claim 7, characterized in that said mobilizing means are connected to the carriage.

9. A method to transfer a canister containing radioactive material, from a first to a second entity chosen from among the group consisting of a cask and a receiver housing delimited by an inner surface, characterized in that it comprises the following successive steps consisting of:

bringing the canister located inside the first entity to a carried position in which this canister is free of any contact with said inner surface associated with said first entity;

mobilizing said extraction/insertion assembly carrying the canister so as to cause this extraction assembly and the canister to enter inside said second entity.

10. A method according to claim 9, characterized in that said first entity consists of the cask.

11. A method according to claim 10, characterized in that said step consisting of setting in movement said extraction/insertion assembly is conducted in a direction of extraction in the longitudinal direction of the cask, and in that it is followed by the following successive steps consisting of:

bringing the canister to a deposited position inside the receiver housing in which this canister is free of any contact with said extraction assembly; and setting in movement said extraction assembly in an opposite direction to the direction of extraction, so as to re-insert this extraction assembly inside said cask.

12. A method according to claim 11, characterized in that said canister extraction assembly belongs to an extraction system for a canister containing radioactive material, this canister configured to be extracted from and inserted in a cask housing delimited by an inner surface of a cask, said system comprising a canister extraction/insertion assembly configured to bear against said inner surface of the cask and being provided with a carriage and canister support structure carried by said carriage, said carriage and support structure configured to take up a drawn-together position in a radial direction of the cask allowing contact between the canister and said inner surface, and a drawn-apart position in the radial direction of the cask in which the canister carried by the support structure takes up a carried position in which this canister is free of any contact with said inner surface, one of the two elements from among said carriage and said support structure being provided with at least one guide ramp cooperating with a ramp follower provided on the other of said two elements, said ramp configured so that the application of a relative translational movement between the carriage and canister support structure, in a longitudinal direction of the cask, causes the changeover of said two elements from said drawn-together position to said drawn-apart position, or conversely, said extraction system also comprising mobilizing means in the longitudinal direction of the cask connected to one of said two elements, and retractable abutment means cooperating with the other of said two elements, the extraction system being used to implement said transfer method.

13. A method according to claim 12, characterized in that said step consisting of bringing the canister to its carried position inside the cask is conducted by implementing the following successive operations:

connecting said mobilizing means of the extraction system to one of said two elements from among said carriage and said support structure of the extraction assembly;

actuating a first abutment belonging to said retractable abutment means so as to bring this first abutment from a retracted position to an abutting position allowing the locking in translation of the other of said two elements in the direction of extraction of said longitudinal direction of the cask;

actuating mobilizing means in the direction of extraction so as to cause movement of the carriage and support structure from said drawn-together position to said drawn-apart position; and actuating said first abutment so as to bring it from said abutting position to said retracted position.

14. A method according to claim 12, characterized in that said step consisting of bringing the canister to a deposited position inside the receiver housing is conducted by implementing the following successive operations:

actuating a second abutment belonging to said retractable abutment means so as to bring this second abutment from a retracted position to an abutting position allowing the locking in translation of the other of said two elements in the opposite direction to the direction of extraction;

actuating mobilizing means in said opposite direction to cause displacement of said carriage and support structure from said drawn-apart position to said drawn-together position; and actuating said second abutment so as to bring it from said abutting position to said retracted position.

* * * * *